United States Patent [19]

Mourning et al.

[11] Patent Number: 4,777,906

[45] Date of Patent: Oct. 18, 1988

[54] EPOXY MIXING AND DISPENSING SYSTEM

[75] Inventors: Richard C. Mourning, Prior Lake; Gordon W. Nygren, Bloomington, both of Minn.

[73] Assignee: Magnetic Peripherals Inc., Minneapolis, Minn.

[21] Appl. No.: 794,156

[22] Filed: Nov. 1, 1985

[51] Int. Cl.[4] ..... B05C 11/02; B01F 5/00; B01F 15/02

[52] U.S. Cl. ..... 118/106; 118/122; 366/162; 366/177; 366/349; 425/372

[58] Field of Search ..... 366/162, 177, 182, 342, 366/348, 349; 118/243, 257, 263, 106, 122; 425/115, 371, 372

[56] References Cited

U.S. PATENT DOCUMENTS

| | | | |
|---|---|---|---|
| 795,581 | 7/1905 | Corby et al. | 425/372 |
| 2,281,497 | 4/1942 | Hyson et al. | 366/162 |
| 3,084,915 | 4/1963 | Martinez et al. | 366/177 X |
| 3,302,832 | 2/1967 | Hardman et al. | 366/162 X |
| 3,476,363 | 11/1969 | Chikamasa et al. | 366/162 |
| 3,920,223 | 11/1975 | Krueger | 366/162 X |
| 3,991,705 | 11/1976 | Adler | 118/257 X |
| 4,054,270 | 10/1977 | Gugger et al. | 366/177 X |
| 4,202,635 | 5/1980 | Hendrickson | 366/162 |
| 4,334,787 | 6/1982 | Kluth et al. | 366/162 |
| 4,538,920 | 9/1985 | Drake | 366/177 |

FOREIGN PATENT DOCUMENTS

| | | | |
|---|---|---|---|
| 699361 | 11/1940 | Fed. Rep. of Germany | 425/371 |
| 3119949 | 12/1982 | Fed. Rep. of Germany | 366/177 |
| 510999 | 9/1920 | France | 425/371 |
| 58-16832 | 1/1983 | Japan | 366/177 |
| 335946 | 3/1959 | Switzerland | 366/182 |
| 2119269 | 11/1983 | United Kingdom | 366/349 |

*Primary Examiner*—Robert R. Mackey

*Attorney, Agent, or Firm*—Joseph A. Genovese; Edward L. Schwarz

[57] ABSTRACT

Apparatus is shown for mixing and dispensing an epoxy adhesive. An epoxy resin and its associated curing agent are simultaneously loaded from separate cartridges into a length of flexible PVC tubing, part of which is contained between a rotor and a stator. Bearings, mounted rotatably about the rotor, engage and travel along the tubing as the rotor is revolved, each bearing compressing the tubing at its point of engagement. The tubing, repeatedly compressed and released by each bearing in succession, kneads the epoxy resin and curing agent into a homogeneous mixture. From the tubing, the epoxy mixture is deposited on a moving carrier tape and forms a continuous bead. Downstream, a control tape is spaced apart from the carrier tape and moves in the opposite direction. As the bead encounters the control tape, the control tape removes part of the bead material from the carrier tape and plastically forms the remaining mixture into a film of a uniform thickness substantially less than the bead diameter. Further downstream, an automatic pick-up device contacts the film over a controlled area and thus picks up a controlled amount of the epoxy mixture.

15 Claims, 4 Drawing Sheets

EPOXY MIXING AND DISPENSING SYSTEM

BACKGROUND OF THE INVENTION

This invention relates to an apparatus and method for mixing an epoxy resin and associated curing agent into an epoxy adhesive, and for dispensing the adhesive in precise, controlled amounts.

Its subject matter is similar to that of U.S. patent application No. 794,207, Epoxy Mixing System, now U.S. Pat. No. 4,668,097 granted May 26, 1987 whose inventor, Richard Mourning, is one of the inventors of this application. These applications have a common filing date and assignee.

Epoxy materials are popular as adhesives due to their hardness, bonding strength, and their ability to harden with little or no shrinkage. Such adhesives typically include two constituents: an epoxy resin and a curing or hardening agent. The resin and curing agent are separately packaged until use, at which time they are combined to initiate curing.

Users of these adhesives do, however, encounter problems. Care must be taken when mixing the constituents by hand, because the constituents can be irritating to the skin and eyes, and they must be mixed in consistently accurate proportions. It is difficult to apply the adhesive by hand in accurate amounts, particularly when joining minute components. Users mixing and using epoxy adhesive in batches must cope with the change in the adhesive properties over curing time or "pot life". Further, cleaning of equipment used to mix and handle the epoxy adhesive is difficult, and solvents used for such cleaning can be hazardous.

Prior art attempts to address some of these problems are shown, for example, in U.S. Pat. No. 4,090,262 to Schneider et al. granted May 16, 1978. Schneider shows separate tanks 1 and 2 for components "A" and "B" of a mixture, both being simultaneously propelled by a pressure source 3. Flow metering pumps 7 and 8 ensure that components A and B reach mixing chamber 16 in properly proportioned amounts. A hydraulic piston 14 positively cleans the mixing chamber. An alternate mixing chamber 20 has a stirring mechanism which must be cleaned with a solvent.

U.S. Pat. No. 2,894,732 to Taber et al. granted July 14, 1959, shows separate tanks 35 and 36 for a hardening agent and convertible resin. These components are propelled by pressure through fluid chambers 7 and 8, to a disposable mixing unit. A tube in the mixing unit is packed with metal chips 68 which cause the agent and resin to traverse "tortuous, irregularly intercommunicating flow passages", and thereby mix.

In connection with handling and dispensing epoxy adhesives, the prior art affords various examples of handling pliable materials. For example, U.S. Pat. No. 4,462,852 to Custor, granted July 31, 1984, shows rollers 5 and 6 for shaping a pliable thermoplastic. U.S. Pat. No. 4,420,357 to Neubauer et al., granted Dec. 13, 1983, shows an apparatus for continuous manufacture of particle board, in which the particle board material is compressed at a station 8 Finally, U.S. Pat. No. 3,972,672 to Castro, granted Aug. 3, 1976, illustrates a machine for flattening dough buns between a drum 12 and belt 13 in order to form tortilla shells.

While these prior art arrangements function satisfactorily in meeting their specific requirements, they fail to adequately address the challenge of applying accurate, controlled amounts of epoxy adhesive and timing the dispensing of epoxy such that when used, it is consistently at or near a desired point in its curing stage.

It is therefore an object of the present invention to provide an apparatus to accurately and thoroughly mix the several components of an epoxy adhesive while requiring no direct operator contact. A further object is to reduce or eliminate the need to clean apparatus used to mix and dispense the adhesive. Yet another object of the invention is to enhance operator safety by minimizing direct contact in mixing and handling epoxy adhesive and its constituents. Finally, it is an object of the invention to dispense mixed epoxy adhesive in precise, controlled amounts, and at a controlled age in its curing.

SUMMARY OF THE INVENTION

To achieve these and other objects, there is provided an apparatus for combining a plurality of constituents into a substantially uniform and malleable mixture, and for shaping the mixture into a film of a constant, controlled thickness.

The apparatus includes an elongate and flexible conduit, and a supply means for simultaneously introducing a plurality of constituents into the conduit at an inlet of the conduit. A forcing means moves the constituents through the conduit from its inlet to its outlet. A conduit flexing means is provided for repeatedly compressing and releasing the conduit in a transverse direction and along a selected length of the conduit as the constituents are moved through it.

A first carrier having a substantially flat first surface is provided near the conduit outlet. A means provides movement of the first carrier so that the mixture is deposited on the first surface in a bead, elongate in the direction of carrier movement and having a generally constant bead thickness.

A second carrier is provided, with a substantially flat second surface. Support means position the second surface in spaced apart relation to the first surface a preselected minimum distance from it at a control location downstream from the conduit. The preselected distance is substantially less than the bead thickness. As the bead encounters the second surface, some of the mixture is deposited on the second surface. The remainder of the mixture is plastically formed into a film on the first surface having a uniform thickness substantially equal to the preselected distance.

The flexing means can comprise a rotor, a stator positioned in spaced-apart relation to the rotor, a drive means for moving the rotor, and a series of protrusions extended from the rotor, with the selected length of the conduit contained between the rotor and the stator. As the drive means move the rotor, the protrusions compress and release the conduit over the selected length. The rotor can be circular, and revolved by the drive means. The drive means can include a motor and a drive belt connecting two pulleys, one mounted to the motor and the other mounted to the rotor.

The protrusions preferably are cylindrical bearings rotatably mounted about the rotor periphery. When contacting the conduit during rotor movement, the bearings rotate in the direction opposite to that of rotor movement. A further advantage is gained from providing a groove in the stator for containing the conduit.

The preferred first carrier is a first tape running from a first supply reel to a first take-up reel. The movement providing means is a first drive motor driveably engaged with the first tape. The apparatus further can include a means for moving the second carrier in the direction opposite to the direction of first carrier movement. As a result of such movement, the second carrier removes that portion of the bead deposited on the second carrier, and continually provides the second carrier free of the mixture at the control location.

Preferably, the second carrier is a second tape running from a second supply reel to a second take-up reel. A second motor driveably engages the second tape to move it.

In order to effectively control the thickness, the apparatus can include a first roller for supporting the first tape near the control location. Also, the second support means can comprise a second roller spaced apart from the first roller. If desired, the second roller can be adjustable to permit a range of values for the preselected distance.

The mixing and dispensing apparatus of this invention can be employed to practice a method of mixing a plurality of constituents into a uniform mixture and dispensing said mixture comprising the steps of:

(1) simultaneously supplying a plurality of constituents to an elongate, flexible conduit;

(2) forcing the constituents through the conduit, and flexing the conduit over at least a portion of its length to repeatedly compress and release the conduit in a transverse direction as the constituents are moved through the conduit;

(3) delivering said mixture from said conduit onto a first flat surface moving with respect to the flexible conduit to form a bead of the mixture, elongate in the direction of first surface movement and having a generally consistent thickness; and (4) supporting a second flat surface spaced apart from the first surface a preselected distance and at a location downstream from the conduit; whereby some of the bead, as it encounters the second surface, is deposited on the second surface, the remainder of the bead being plastically formed into a film on said first surface and of uniform thickness substantially equal to the preselected distance.

The apparatus and method of this invention provide for the thorough and proportionately accurate combination of constituents into a homogenous mixture, without any direct operator contact, thus to eliminate the risk of skin irritation or eye damage while hand mixing components. The flexible conduit can be discarded after use, eliminating the clean-up and the accompanying hazard of cleaning solvents. Also, for a given epoxy adhesive, the length of the flexible conduit and piston speed can be selected such that the adhesive mixture is presented for application at an ideal time after the initial combining of constituents. Finally, the epoxy adhesive mixture can be dispensed in controlled, accurate amounts, including micro dots, without any direct operator contact. When tapes are used as the carrier and as the control surface, they can be collected on their respective reels and discarded, further reducing the need for cleaning.

IN THE DRAWINGS

These and other features and advantages of the invention will become apparent upon reading the following detailed description and upon reference to the drawings, in which.

DETAILED DESCRIPTION OF THE PREFERRED EMBODIMENT

Figure 1:
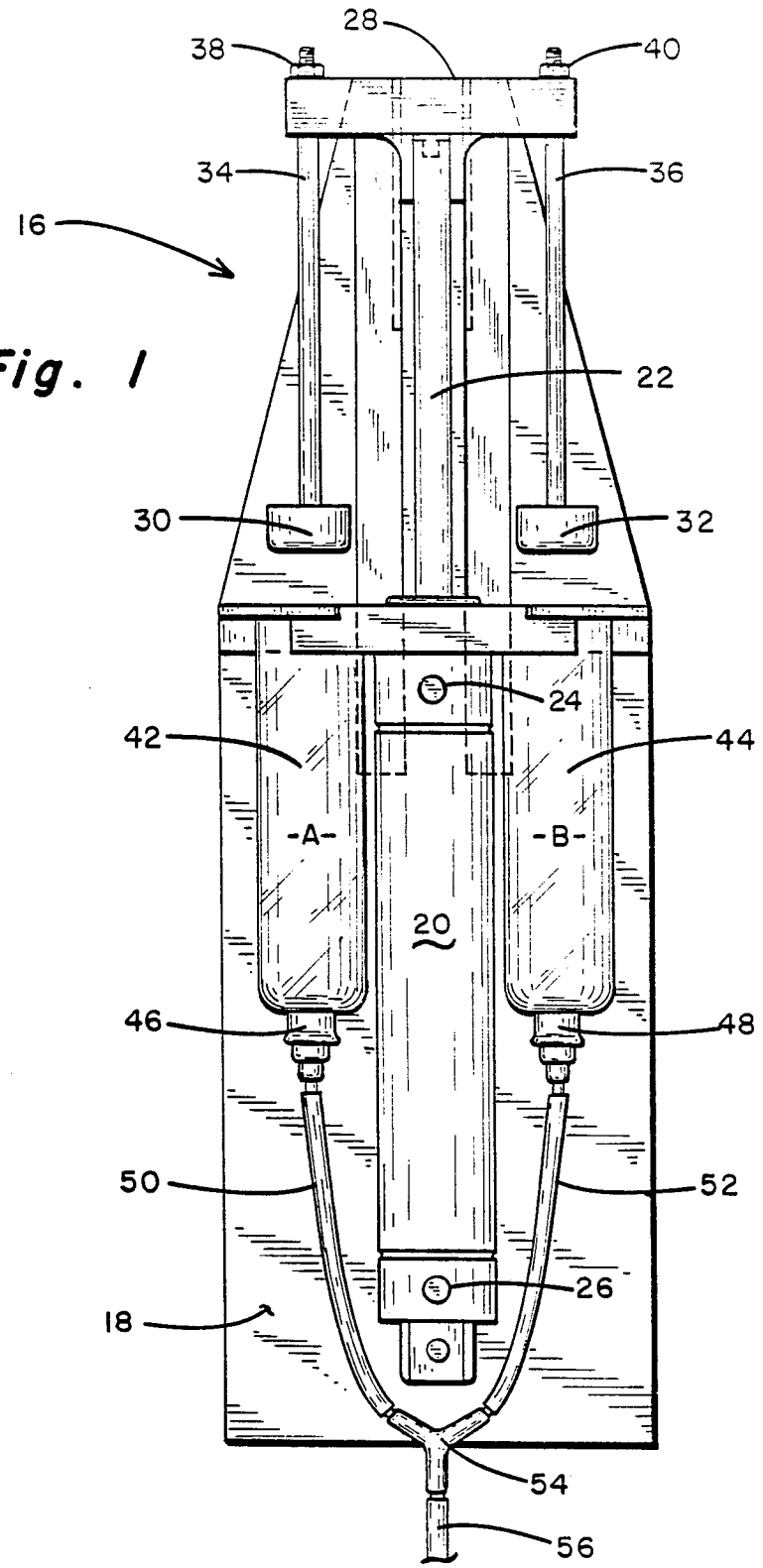
FIG. 1 is a front elevation of a constituent pumping station constructed in accordance with the present invention.

Turning now to the drawings, there is shown in FIG. 1 an epoxy pumping station 16. Station 16 includes a base 18 to which is mounted a pneumatic cylinder 20. A piston 22 reciprocates in cylinder 20. Cylinder 20 has a first air supply port 24 near its top, and a second air supply port 26 near the bottom. Pressurized air supplied to port 24 causes piston 22 to travel downward in cylinder 20. The return stroke may be caused by pressurized air applied through port 26 to actuate piston 22, or by spring loading of piston 22 in a conventional fashion.

Mounted to the upper end of piston 22 is a bar 28. First and second plungers 30 and 32 are mounted to bar 28 on opposite sides of piston 22. The plungers have first and second plunger rods 34 and 36, which have threaded ends that enable their mounting to bar 28 using internally threaded plunger nuts 38 and 40.

Aligned with plungers 30 and 32 are a first cartridge retainer 42 and a second cartridge retainer 44, respectively. Retainers 42 and 44 are cylindrical, each having an interior diameter slightly larger than the diameter of its corresponding plunger. When in use, retainer 42 is loaded with a disposable plastic cartridge of a constituent "A" which preferably is an epoxy resin. A corresponding cartridge of a constituent "B", the associated curing agent for the epoxy resin, is loaded into retainer 44. The retainers preferably are constructed of steel, and sized to contain the cartridges in a snug fit. The cartridges are commercially available, and are packaged with integral pistons and with the constituent free of entrapped air.

It is seen from FIG. 1 that plungers 30 and 32 reciprocate along with piston 22 as it reciprocates, all three members traveling the same distance during each stroke. Thus, the stroke of piston 22 in cylinder 20 is set to allow removal of the plungers from their respective retainers for loading of the epoxy constituents, and in the opposite direction, to permit the plungers to completely evacuate their respective retainers. The volume of constituent expelled is controlled by the plunger displacement and the cross-sectional area of its associated cartridge. Thus, if equal amounts of constituents A and B are desired, retainers 42 and 44 and their cartridges are of equal size. Comparative cross-sectional areas of the cartridges and retainers can be selected to meet different proportional requirements if desired.

Protruding from the cartridge bottom ends are first and second nipple ends 46 and 48, to which are connected first and second tubing elements 50 and 52, respectively. These tubing elements, in turn, are connected to the inlets of a Y-type connector 54. Connected to the outlet of Y-type connector 54 is a third tubing element 56 which comprises a common conduit for constituents A and B. While it is essential that third tubing element 56 be flexible, it is preferable that tubing elements 52 and 50 also be flexible. A suggested material for the tubing is polyvinylchloride (PVC), e.g. of a type sold under the brand name "Tygon".

Figure 2:
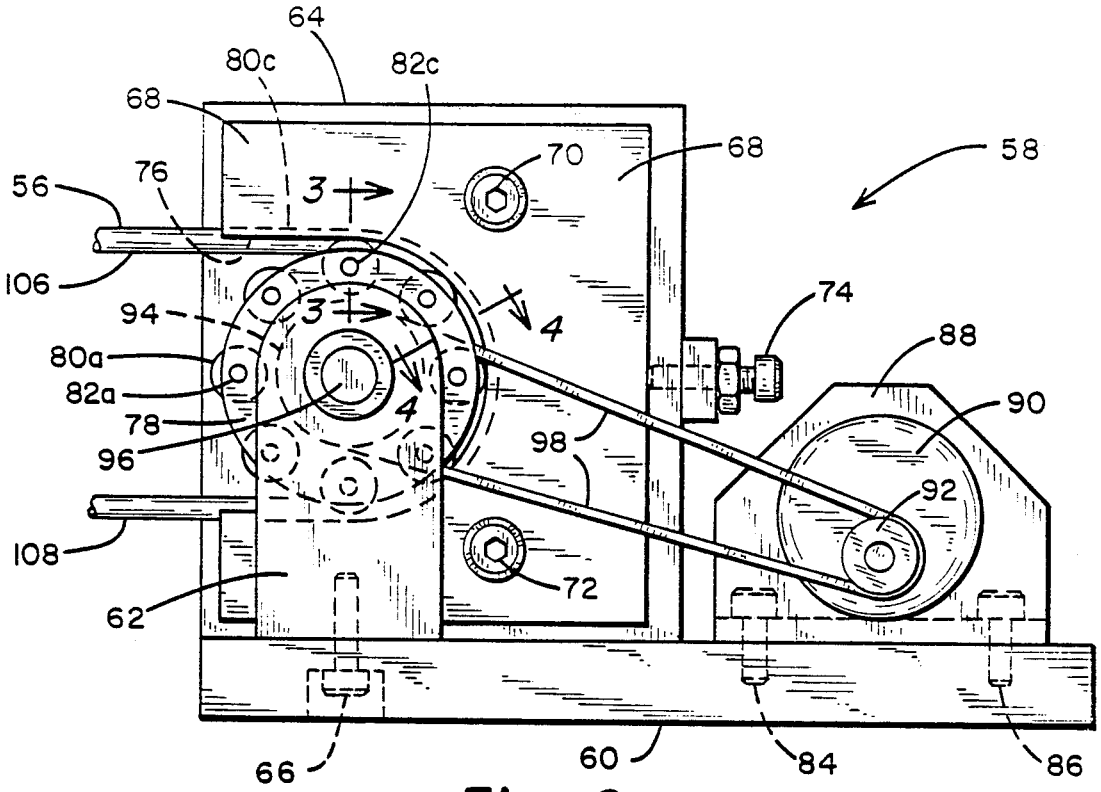
FIG. 2 is a front elevation of an epoxy mixing station constructed in accordance with the present invention.

FIG. 2 shows mounted first and second upright an epoxy mixing station 58 including a mixing station base 60, to which are mounted first and second upright frame members 62 and 64. A plurality of bolts, one of which is shown at 66, mount the frame members to the base. Attached to second frame member 64 is a stator 68, by use of first and second stator bolts 70 and 72. A stator adjust bolt 74 can be provided if desired, in which case the openings for bolts 70 and 72 in stator 68 or member 64 can be slotted to permit limited horizontal travel of the stator.

By virtue of a U-shaped opening 76, stator 68 is adapted to receive a rotor 78, supported between frame members 62 and 64 so that it revolves in the clockwise direction as viewed in FIG. 2. A series of substantially identical cylindrical bearings, two of which are identified at 80*a* and 80*c*, are mounted to rotor 78 about its periphery by means of pins, two of which are identified as 82*a* and 82*c*. The bearings rotate with respect to the rotor. Rotor 78 and stator 68 are mounted in spaced apart relation to one another, to permit the threading or insertion of tubing element 56 between them, yet are sufficiently close to one another to contain the tubing element as the bearings roll along and against it.

Also attached to base 60, by bolts 84 and 86, is a motor support frame member 88 to which is mounted a motor 90. Attached to the shaft of motor 90 is a motor pulley 92, and a corresponding rotor pulley 94 is attached to a central shaft 96 which supports the rotor. An endless belt 98, mounted to pulleys 92 and 94, drivingly engages motor 90 and rotor 78.

Figure 3:
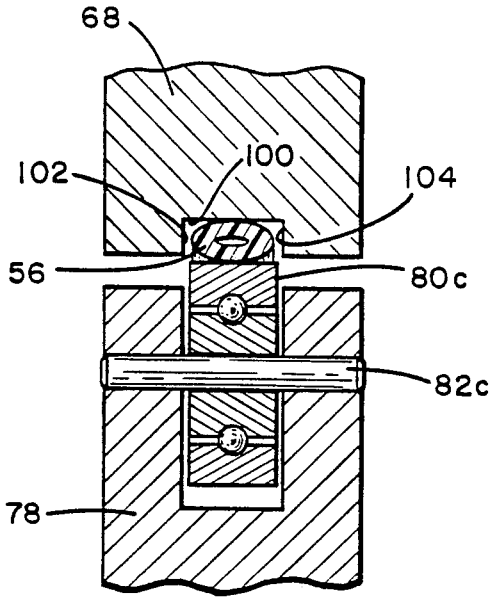
FIG. 3 is an enlarged cross-sectional view taken along the line 3—3 in FIG. 2.
Figure 4:
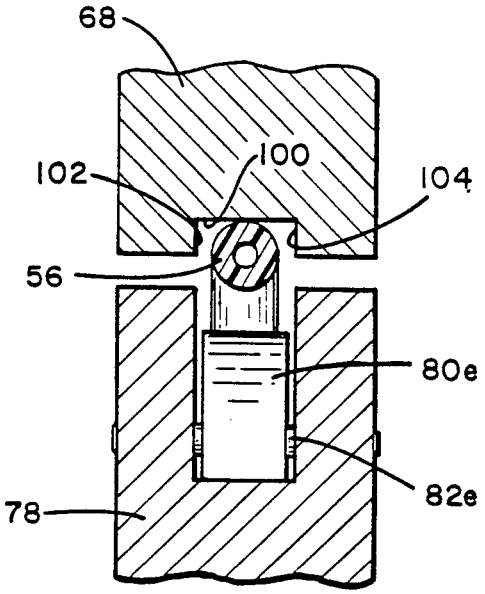
FIG. 4 is an enlarged cross-sectional view taken along the line 4—4 in FIG. 2.

The containment of conduit or tubing element 56 between rotor 78 and stator 68 is best seen in FIGS. 3 and 4. Formed in the stator is a continuous groove 100 having side walls 102 and 104 which restrain tubing element 56 against axial movement with respect to the rotor and stator. Bearing 80*c* protrudes radially outwardly of the rotor perimeter to compress tubing 56 out of its normal, circular cross-section into an oval shape. Groove 100 is sized so that tubing 56 is not compressed flat, for it has been found that partial compression is sufficient for achieving thorough mixture of constituents A and B. Excessive compression would cause premature wearing of tubing 56. For example, a tubing element having a 1/16 inch interior diameter preferably is compressed to an interior height less than half of the diameter.

From FIG. 4 it is seen that portions of tubing 56 not in contact with one of the bearings return to the normal, unstressed, circular configuration. Thus, as rotor 78 revolves in the clockwise direction as viewed in FIG. 2, each bearing 80 rotates in the opposite direction, i.e. counterclockwise. This allows each bearing to maintain contact against tubing 56 without causing undue friction between the bearing and tubing, substantially preventing wear to the tubing. As the rotor revolves, and as the epoxy constituents are pushed through tubing element 56 by plungers 30 and 32, tubing 56 is rapidly and repeatedly compressed a controlled amount, in the axial or transverse direction, at and near its areas of bearing contact, then released when between successive bearings. This produces a uniform kneading action on constituents A and B, forming them into a homogeneous mixture.

The effectiveness of rotor 78 in mixing the epoxy components can be readily observed if transparent polyvinylchloride is used for tubing element 56, and if the epoxy resin and curing agent are of different colors. Then, these constituents may be seen to resemble two-color toothpaste as they traverse an upper conduit portion 106 of tubing element 56, and emerge from the rotor in a lower conduit portion 108 as a thoroughly blended epoxy adhesive.

A consistently well proportioned and homogeneous mixture of epoxy adhesive is thus acheived without any direct operator contact, and without any danger of skin and eye contact with potentially harmful components. Post-mixing cleanup is avoided by simply discarding third tubing element 56. There is no need to clean the rotor or stator, as these never come into direct contact with the epoxy constituents.

Figure 5:
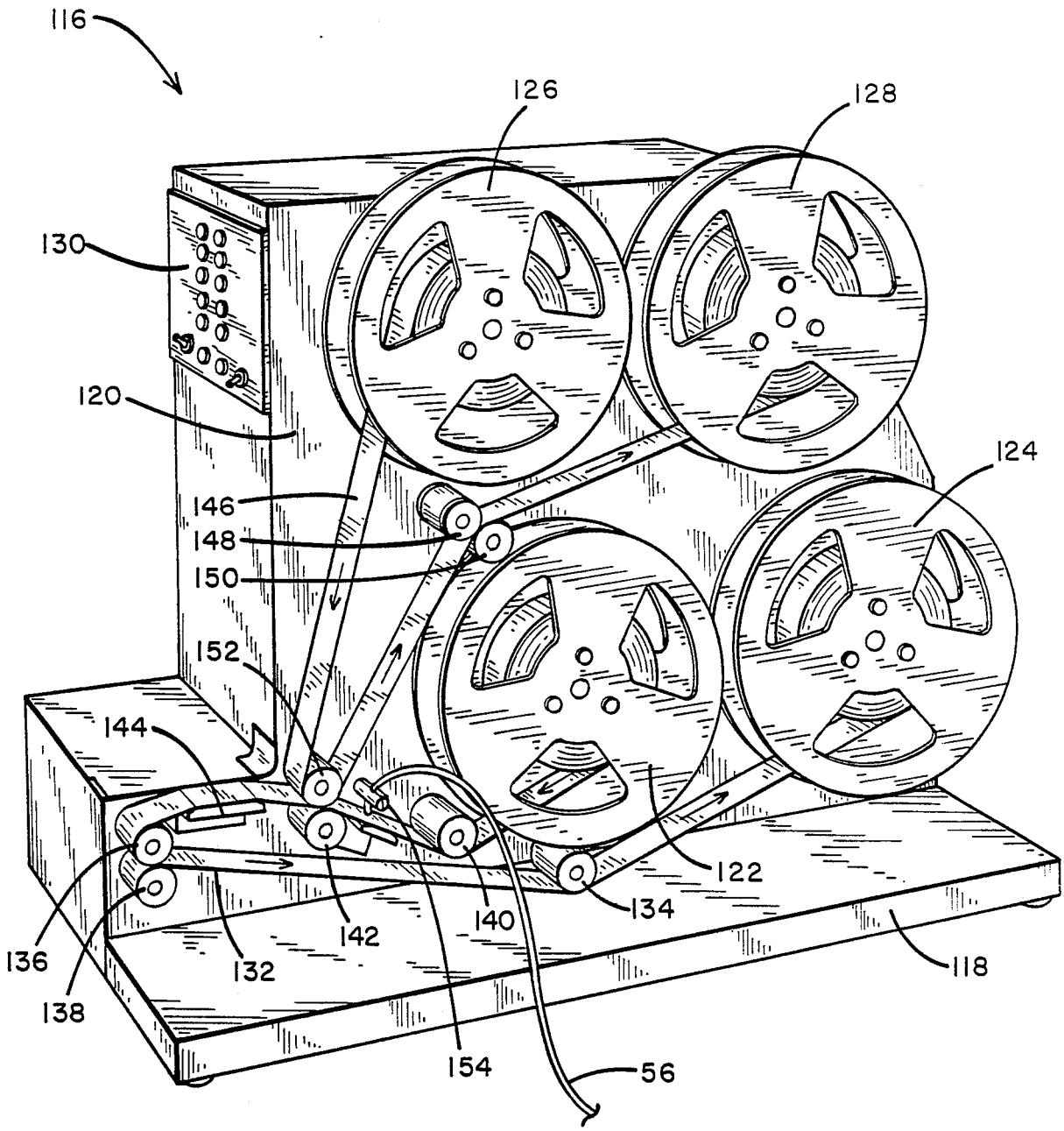
FIG. 5 is a perspective view of an epoxy adhesive dispensing station constructed in accordance with the present invention.

FIG. 5 shows an epoxy adhesive dispensing station 116 including a base 118 with an upright panel 120 fixed to the base. Supported on panel 120 are four tape reels: a conveyor supply reel 122, a conveyor take-up reel 124, a control supply reel 126, and a control take-up reel 128. Also mounted to upright panel 120 is a control panel 130 for operating dispensing station 116.

Running between supply reel 122 and take-up reel 124 is a conveyor tape 132, controlled by three conveyor guide rollers 134, 138 and 140, and a conveyor drive roller 136. A fifth roller, a conveyor positioner roller 142, plays a direct role in determining the thickness of a film of the epoxy adhesive as is later explained. Downstream from positioner roller 142, conveyor tape 132 is supported by a platform 144.

Running between control supply reel 126 and control take-up reel 128 is a flexible control tape 146, its path being determined in part by a control drive roller 148, a control guide roller 150, and a cylindrical control positioner roller 152.

As shown in FIG. 5, tension is placed on control tape 146 which conforms it to the cylindrical shape or roller 152 where control tape 146 passes most closely to conveyor tape 132. Positioner roller 152 cooperates with positioner roller 142 to determine epoxy adhesive film thickness. Tapes 132 and 146 preferably are paper tape.

A portion of the freshly mixed epxoy adhesive is dispensed from conveyor tape 132 to control tape 146 at the dispensing station 116. The dispensing station 116 is operated by winding tapes 132 and 146 onto take-up reels 124 and 128, respectively. Each take-up reel travels in a counterclockwise direction as viewed in FIG. 5. As a result, tape 132 travels in the opposite direction relative to the travel of tape 146 at a control location where the separation distance between the tapes is at a minimum.

Figure 6:
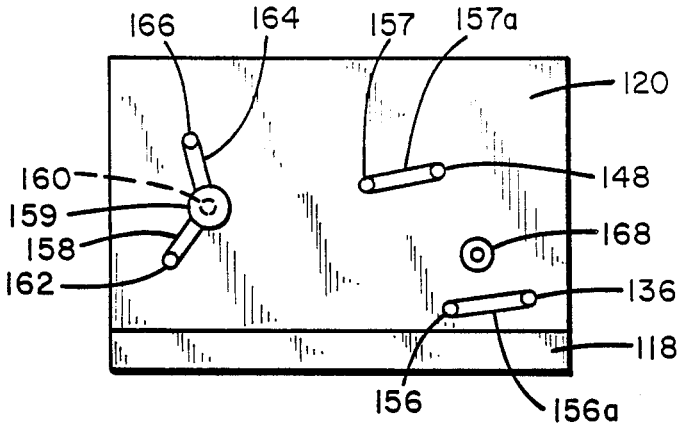
FIG. 6 is a schematic view illustrating reel and tape drive means and idler roller adjustment for the apparatus of FIG. 5.

As seen in FIG. 6, drive rollers 136 and 148 are rotated by first and second drive motors 156 and 157 located behind panel 120. Drive belts 156*a* and 157*a* link their associated motors and drive rollers. A first reel drive belt 158 engages reel drive motor 159 at its pulley 160 and a conveyor pulley 162 to rotate the conveyor take-up reel, while a second reel drive belt 164 engages pulley 160 and a control pulley 166 to rotate control take-up reel 128. Motor 159 does not control tape speed, but merely takes up the slack of both tapes. Belts 158 and 164 allow slippage for this purpose. Control tape 146 preferably is moved at a considerably slower speed than is conveyor tape 132. The speed of control tape 146 and conveyor tape 132 course be selected to suit the particular epoxy adhesive. In one example, a conveyor tape speed of seven inches per minute and a control tape speed of one inch per minute was found satisfactory.

Film thickness is controlled by the minimum separation between conveyor tape 132 and control tape 146, which is preselected by setting the distance between positioner rollers 142 and 152. As seen in FIG. 6, this preselected distance can be changed over a limited range, if desired, by raising or lowering control positioner roller 152. The means shown to achieve this include an eccentric sleeve 168, although other devices, e.g., a pivot arm for roller 152, would suffice.

Figure 7:
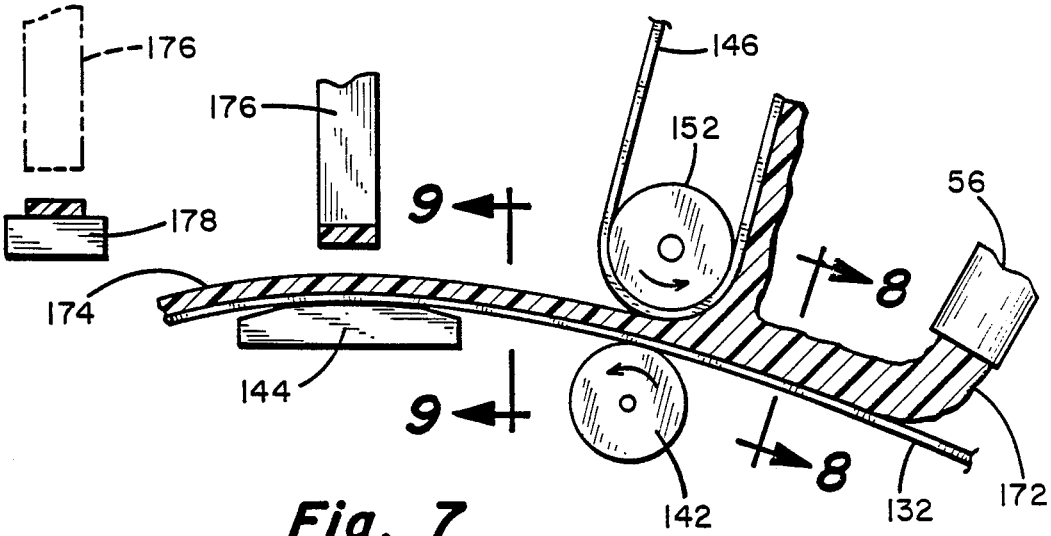
FIGS. 7–9 are schematic views illustrating the operation of the dispensing apparatus.
Figure 8:
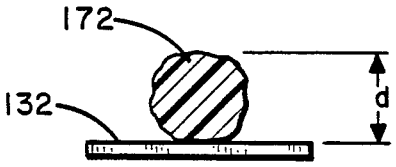
Figure 9:
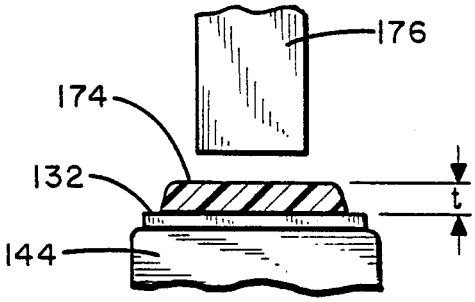

Operation of the dispensing station 116 is understood from drawing FIGS. 7–9. Epoxy adhesive is delivered to the dispensing station through tubing element 56, with conveyor tape 132 moving from right to left as viewed in FIG. 7. The adhesive, when deposited, forms a continuous bead 172 elongated in the direction tape 132 is moving, and having a fairly constant bead thickness or diameter d (see FIG. 8), e.g. 0.03–0.05 inches. Downstream from tubing element 56, bead 172 enters the control location and encounters control tape 146 which is moving from left to right. Because the preselected distance between tapes 132 and 146 is substantially less than the bead thickness, some of the adhesive from bead 172 is deposited on control tape 146 and is carried away to control take-up reel 128. The remainder the adhesive in the bead is plastically shaped into a film 174, having a constant, controlled thickness t (FIG. 9), e.g. 0.005 inches, substantially equal to the preselected distance between tapes 132 and 146 at the control location. The thickness of film 174 is uniform, because tapes 132 and 146 are essentially flat, and because the adhesive is a malleable or pliable substance.

Downstream from the control location, conveyor tape 132 and film 174 are supported by platform 144. Above the platform is a probe 176 which can be a "pick-and-place" device such as is known in the automatic manufacturing art. Probe 176 is lowered over the center of film 174 and picks up an amount of epoxy from the film. During pick-up, the tape is stopped momentarily to avoid relative horizontal movement between the probe and tape. As probe 176 is narrower than film 174 (see FIG. 9), the amount of epoxy adhering to the probe is controlled by thickness t and the probe cross sectional shape. After picking up adhesive, probe 176 (broken lines in FIG. 7) is moved to a receiving station 178 to dispense (e.g. by implantation) the controlled amount of adhesive. Though not shown in FIG. 7, rotating brushes soaked in solvents can be provided to clean probe 176 during its return to the location over platform 144 to pick up a subsequent amount of adhesive.

Thus, without any direct operator intervention, repeatedly controlled amounts of adhesive are dispensed to the receiving station which can be, for example, a minute part such as a slider for a data recording transducer. After dispensing is complete, or in any event once take-up reels 124 and 128 become filled with used tape, the tape from these reels is simply discarded. Consequently, little or no cleaning is necessary.

We claim:

1. An apparatus for combining a plurality of constituents into a substantially uniform and malleable mixture, and for shaping the mixture into a film of a constant, controlled thickness, at least a portion of which film can be dispensed at a receiving station, and including:

an elongate, flexible conduit, and a supply means for simultaneously introducing a plurality of constituents into said conduit at an inlet thereof;

a forcing means for moving said constituents through said conduit from said inlet to an outlet thereof;

a conduit flexing means for repeatedly compressing and releasing said conduit in a transverse direction and along a selected length of the conduit, as said constituents are moved through said conduit to form a mixture of said constituents;

a first carrier having a substantially flat first surface proximate the outlet of said conduit;

means for providing movement of said first carrier relative to said conduit so that said mixture from said conduit is deposited to said first surface in a bead elongate in the direction of said movement and having a generally constant bead thickness;

a second carrier having a substantially flat second surface, and a support means for positioning said second surface in spaced apart relation to said first surface at a preselected minimum distance therefrom at a control location downstream from said conduit outlet, said preselected distance being substantially less than said bead thickness; and means for moving said second carrier in the direction opposite to the direction of first carrier movement; whereby a portion of said bead is deposited on said second surface and removed from the first surface as the bead encounters said second surface at said control location and wherein the remainder of said bead is plastically formed into a film on said first surface with a uniform thickness substantially equal to said preselected distance, and available for dispensing at the receiving station.

2. The apparatus of claim 1 wherein said conduit flexing means includes a rotor, a stator positioned in spaced apart relation to said rotor, a drive means for moving said rotor, and a series of protrusions extended from said rotor, and wherein said selected length of said conduit is contained between said rotor and said stator; said protrusions compressing and releasing portions of said conduit length as said drive means moves said rotor.

3. The apparatus of claim 2 wherein said rotor is circular, and rotated by said drive means, and wherein said drive means includes a motor and a drive belt engaged with two pulleys, one pulley mounted to the motor and the other mounted to the rotor.

4. The apparatus of claim 3 wherein said protrusions comprise cylindrical bearings rotatably mounted near the perimeter of said rotor; said bearing, when contacting said conduit during rotor rotation, rotating in the direction opposite to that of rotor rotation.

5. The apparatus of claim 4 wherein said stator has a groove for containing said conduit between the stator and rotor.

6. The apparatus of claim 2 wherein said protrusions comprise cylindrical bearings rotatably mounted near the perimeter of said rotor; said bearings, when contacting said conduit during rotor movement, rotating in the direction opposite to that of rotor movement.

7. The apparatus of claim 1 wherein said first carrier comprises a first tape running from a first supply reel to a first take-up reel, said movement providing means comprising a first drive motor and means for driveably engaging said first drive motor with said tape.

8. The apparatus of claim 7 wherein said second carrier comprises a second tape running from a second supply reel to a second take-up reel, said movement providing means comprising a second drive motor and means for driveably engaging said second drive motor with said second tape.

9. The apparatus of claim 7 including a first roller for supporting said first tape at said control location, and wherein said support means for positioning said second surface comprises a second roller spaced apart from said first roller.

10. The apparatus of claim 9 including means for adjustable supporting said second roller to permit a range of values for said preselected distance.

11. An apparatus for shaping a malleable substance into a film of a constant, controlled thickness, at least a portion of which film can be dispensed at a receiving station, and including:

a delivery means for delivering a malleable substance to a first carrier, said first carrier having a substantially flat first surface;

means for providing movement of said first carrier relative to said delivery means so that said substance from said delivery means is deposited on said first surface in a bead, elongate in the direction of said movement and having a generally constant bead thickness;

a flexible second carrier having a second surface, and a cylindrical support means for positioning said second surface in spaced apart relation to said first surface at a preselected minimum distance therefrom at a control location downstream from said delivery means, and conformed to the cylindrical shape of the support means thereat, said preselected distance being substantially less than said bead thickness; and means for moving said second carrier in the direction opposite to the direction of first carrier movement;

whereby a portion of said bead is deposited on said second surface and removed from the first carrier as the bead encounters said second surface at said control location, and wherein the remainder of said bead is plastically formed into a film on said first surface having a uniform thickness substantially equal to said preselected distance, said film on said first surface available for dispensing at a receiving station.

12. The apparatus of claim 11 wherein said first carrier comprises a first tape running from a first supply reel to a first take-up reel, said movement providing means comprising a first motor driveably engaged with said first tape.

13. The apparatus of claim 12 wherein said second carrier comprises a second tape running from a second supply reel to a second take-up reel, said movement providing means comprising a second motor and means for driveably engaging said second motor with said second tape.

14. The apparatus of claim 13 including a first roller for supporting said first tape at said control location, and wherein said support means for positioning said second surface comprises a second roller spaced apart from said first roller.

15. The apparatus of claim 13 including means for adjustably supporting said second roller to permit a range of values for said preselected distance.

* * * * *